US010849447B2

(12) United States Patent
Gemmill

(10) Patent No.: US 10,849,447 B2
(45) Date of Patent: Dec. 1, 2020

(54) BEVERAGE HOLDER CONTAINER WITH CAP

(71) Applicant: Ben Gemmill, Springfield, MO (US)

(72) Inventor: Ben Gemmill, Springfield, MO (US)

( * ) Notice: Subject to any disclaimer, the term of this patent is extended or adjusted under 35 U.S.C. 154(b) by 0 days.

(21) Appl. No.: 16/253,701

(22) Filed: Jan. 22, 2019

(65) Prior Publication Data

US 2019/0150645 A1 May 23, 2019

Related U.S. Application Data

(63) Continuation-in-part of application No. 15/499,932, filed on Apr. 28, 2017, now Pat. No. 10,232,991.

(51) Int. Cl.
*A47G 23/02* (2006.01)
*B65D 81/38* (2006.01)

(52) U.S. Cl.
CPC ..... *A47G 23/0266* (2013.01); *A47G 23/0233* (2013.01); *B65D 81/3876* (2013.01); *B65D 81/3879* (2013.01); *A47G 2023/0275* (2013.01)

(58) Field of Classification Search
CPC ..... A47G 23/0241; A47G 23/0266; A47G 2023/0275; B65D 51/007; B65D 43/16; B65D 51/245
USPC ..... 220/729, 739, 740
See application file for complete search history.

(56) References Cited

U.S. PATENT DOCUMENTS 2,689,760 A * 9/1954 Vanous ..... A47G 23/0266 294/29
4,494,672 A * 1/1985 Pearson ..... B65D 47/088 220/258.2
4,823,975 A * 4/1989 Schwankl ..... A47G 23/0266 220/277
5,058,757 A * 10/1991 Proa ..... A47G 23/00 220/739
5,740,940 A * 4/1998 Weiss ..... B65D 81/3886 220/592.25
5,944,238 A * 8/1999 Stark ..... A45F 5/02 220/287
6,860,399 B2 * 3/2005 Reeves ..... B65D 43/162 220/739
8,485,388 B2 * 7/2013 Tuan ..... A47G 19/12 206/218

* cited by examiner

*Primary Examiner* — J. Gregory Pickett
*Assistant Examiner* — Niki M Eloshway
(74) *Attorney, Agent, or Firm* — The Iwashko Law Firm, PLLC; Lev Ivan Gabriel Iwashko

(57) ABSTRACT

A beverage holding container to hold a can therein, the beverage holding container including a can-holding member to store the can therein, a fixed member having at least a portion thereof inserted within the can-holding member, a pivoting member pivotally connected to the fixed member to pivot from a first position to a second position, and a covering member connected to the pivoting member to keep the can enclosed when the pivoting member is in the first position.

8 Claims, 7 Drawing Sheets

BEVERAGE HOLDER CONTAINER WITH CAP

CROSS REFERENCE TO RELATED APPLICATION

This application claims is a continuation in part of, and therefore, incorporates by reference, U.S. nonprovisional patent application Ser. No. 15/499,932, entitled "Beverage Holder Container Cap," which was filed on Apr. 28, 2017.

BACKGROUND

1. Field

The present general inventive concept relates generally to a beverage holder container, and particularly, to a beverage holder container with a cap.

2. Description of the Related Art

KOOZIES, or beverage container holders, are a common accessory used to maintain the temperature of a canned or bottled beverage. Although, they help to ensure a drink stays cool, their design leaves the top of the drink unprotected and vulnerable to spilling accidents. The beverage holder container cap introduces a simple attachment for traditional beverage container holders that covers the top of all beverages protected by the beverage container holders.

What is needed is a beverage holder container with a cap that protects the top of a beverage and keeps the beverage cool.

SUMMARY

The present general inventive concept provides a beverage holder container with a cap.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a beverage holding container to hold a can therein, the beverage holding container including a can-holding member to store the can therein, a fixed member having at least a portion thereof inserted within the can-holding member, a pivoting member pivotally connected to the fixed member to pivot from a first position to a second position, and a covering member connected to the pivoting member to keep the can enclosed when the pivoting member is in the first position.

The can-holding member may include a fixed member-receiving groove disposed on a portion of a top edge of the can-holding member to receive the fixed member.

The can-holding member may include a bulbous-receiving groove disposed on a portion of an inner surface of the can-holding member.

The fixed member may include a lateral stem affixed to the fixed member-receiving groove, a first vertical stem perpendicularly disposed on a first end of the lateral stem to affix to an inner surface of the can-holding member, and a second vertical stem perpendicularly disposed on a second end of the lateral stem to affix to an outer surface of the can-holding member.

The fixed member may further include a bulbous member disposed on a bottom portion of the first vertical stem to be inserted into the bulbous-receiving member, such that the fixed member resists removal from the can-holding member.

The fixed member may further include at least one ridge disposed on a portion of a surface of the second vertical stem in contact with the outer surface of the main body to increase friction of the fixed member on the outer surface of the main body.

The fixed member may further include a plurality of arms disposed on the second end of the lateral stem, and a plurality of tab-receiving apertures disposed on a portion of the plurality of arms.

The pivoting member may include a vertical stem affixed to an inner portion of the covering member, such that the covering member pivots in response to movement of the pivoting member, a circular lateral stem perpendicularly disposed on the first edge to be affixed on a bottom surface of the covering member, and a second lateral stem perpendicularly disposed on the second edge to affix to the plurality of arms.

The pivoting member further may further include a plurality of tabs disposed on an end of the second lateral stem to affix to the plurality of tab-receiving apertures, such that each of the plurality of tabs deforms in response to being inserted into the plurality of tab-receiving apertures.

The beverage holder container cap may further include a lid member affixed to a portion of a top surface of the covering member to prevent a change in temperature within an interior portion of the beverage holder container cap.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
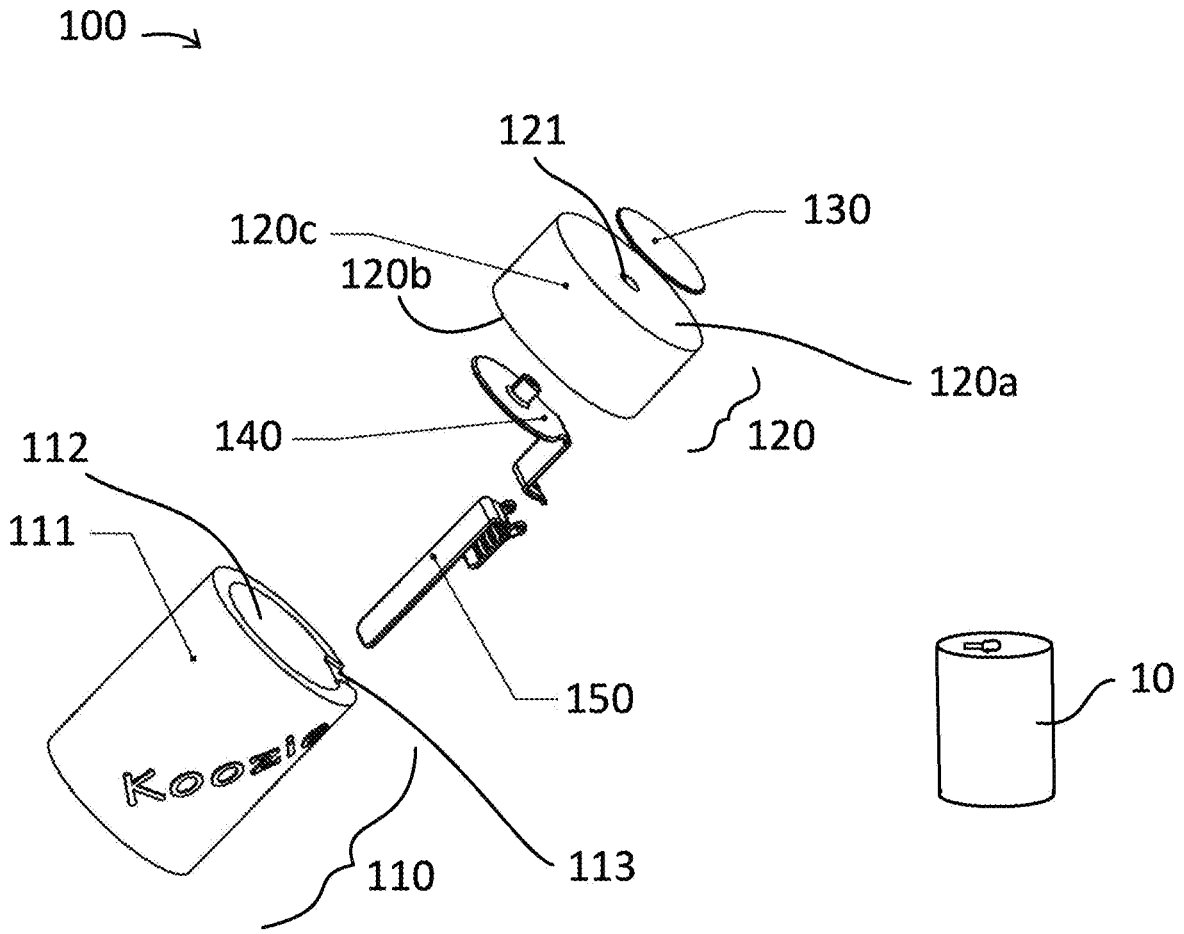
FIG. 1 illustrates an exploded view of a beverage holder container cap, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Can-Holding Member 110
Main Body 111
Can-Receiving Aperture 112
Fixed Member-Receiving Groove 113
Bulbous-Receiving Groove 114
Covering Member 120
Top Surface 120*a*
Bottom Surface 120*b*
Cylindrical Surface 120*c*
Intermediary Surface 120*d*
Protrusion-Receiving Aperture 121
Can-Receiving Aperture 122
Lid Member 130
Top Surface 130*a*
Bottom Surface 130*b*
Extended Bulbous Member 131
Top Portion 131*a*
Bottom Portion 131*b*
Pivoting Member 140
Circular Lateral Stem 141
Top Surface 141*a*
Bottom Surface 141*b*
Protruding Portion 142
Bulbous-Receiving Aperture 142*a*
First Corner Portion 143
Vertical Stem 144
First Surface 144*a*
Second Surface 144*b*
Second Corner Portion 145
Second Lateral Stem 146
Top Surface 146*a*
Bottom Surface 146*b*
Plurality of Tabs 147
Fixed Member 150
First Vertical Stem 151
First Surface 151*a*
Second Surface 151*b*
Bulbous Member 152
First Corner Portion 153
Lateral Stem 154
Top Surface 154*a*
Bottom Surface 154*b*
Plurality of Arms 155
Plurality of Tab-Receiving Apertures 155*a*
Second Corner Portion 156
Second Vertical Stem 157
First Surface 157*a*
Second Surface 157*b*
At Least One Ridge 158

FIG. 1 illustrates an exploded view of a beverage holder container cap 100, according to an exemplary embodiment of the present general inventive concept.

The beverage holder container cap 100 may be constructed from at least one of metal, plastic, wood, glass, and rubber, etc., but is not limited thereto. Furthermore, the beverage holder container cap 100 may be constructed from at least one of an insulated scuba foam, neoprene, and polyisocyanate, but is not limited thereto.

The beverage holder container cap 100 may include a can-holding member 110, a covering member 120, a lid member 130, a pivoting member 140, and a fixed member 150, but is not limited thereto.

Referring to FIG. 1, the beverage holder container cap 100 is illustrated to have a cylindrical prism shape. However, the beverage holder container cap 100 may be rectangular prism, circular prism, pentagonal prism, hexagonal prism, octagonal prism, or any other shape known to one of ordinary skill in the art, but is not limited thereto.

Figure 5A:
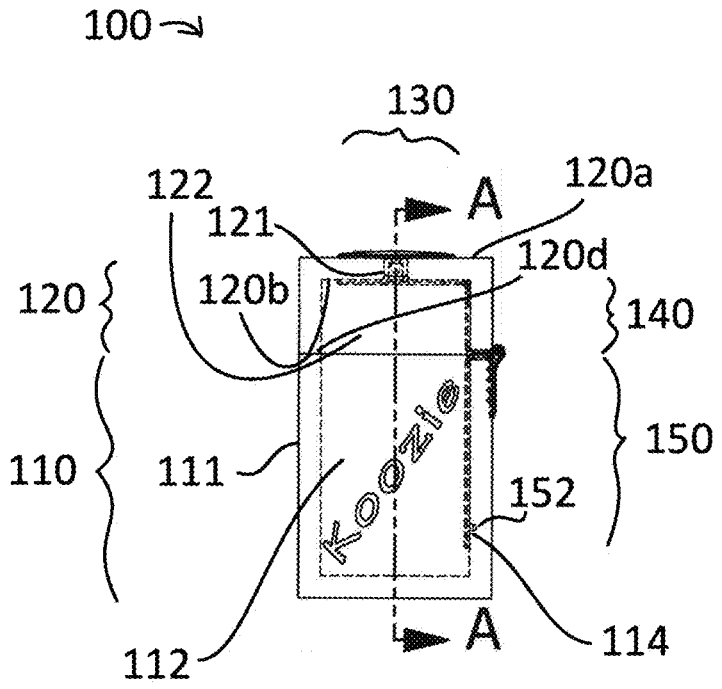
FIG. 5A illustrates a side perspective view of the beverage holder container cap, according to an exemplary embodiment of the present general inventive concept.

Referring to FIGS. 1 and 5A, the can-holding member 110 may include a main body 111, a can-receiving aperture 112, a fixed member-receiving groove 113, and a bulbous-receiving groove 114, but is not limited thereto.

Referring to FIG. 1, the can-receiving aperture 112 may be disposed within a central portion of the main body 111. The fixed member-receiving groove 113 may be disposed along at least a portion of a top edge of the main body 111. The bulbous-receiving groove 114 may be disposed on at least a portion of an inner surface of the main body 111. The main body 111 may include flexible material that enables the main body 111 to take a shape of a can 10 of a predetermined size similar to a diameter of the can-receiving aperture 112, such that the can 10 may snugly fit within the can-receiving aperture 112. Specifically, the can 10 may be inserted into the can-receiving aperture 112, such that the can 10 may cause the main body 111 to stretch and/or widen to accommodate the can 10. As such, the can 10 may be stored within the can-holding member 110.

Figure 5B:
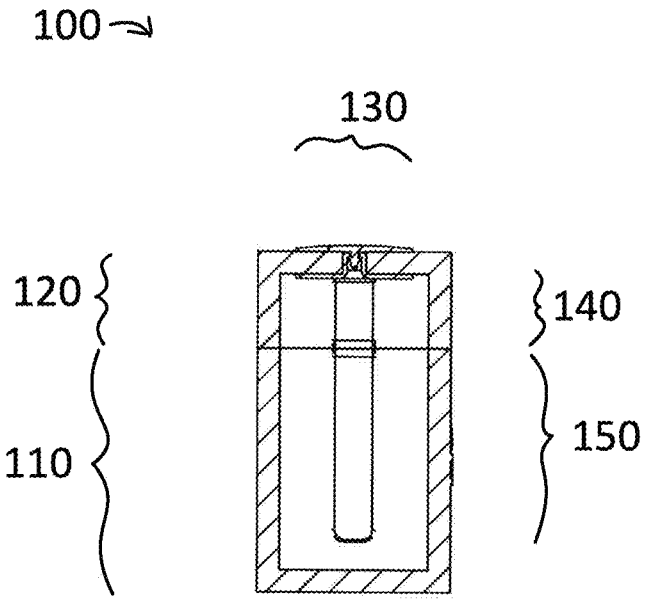
FIG. 5B illustrates a cross-sectional view of FIG. 5A taken along A-A of the beverage holder container cap, according to an exemplary embodiment of the present general inventive concept.

Referring to FIGS. 1 and 5A through 5B, the covering member 120 may include a top surface 120*a*, a bottom surface 120*b*, a cylindrical surface 120*c*, an intermediary surface 120*d*, a protrusion-receiving aperture 121, and a can-receiving aperture 122, but is not limited thereto.

The protrusion-receiving aperture 121 may be disposed within at least a center portion of the top surface 120*a*. The can-receiving aperture 122 may be disposed within at least a center portion of the covering member 120. Moreover, the protrusion-receiving aperture 121 may extend at least a portion of a length of the covering member 120 beginning from the top surface 120*a* and terminating at the bottom surface 120*b*.

Figure 2A:
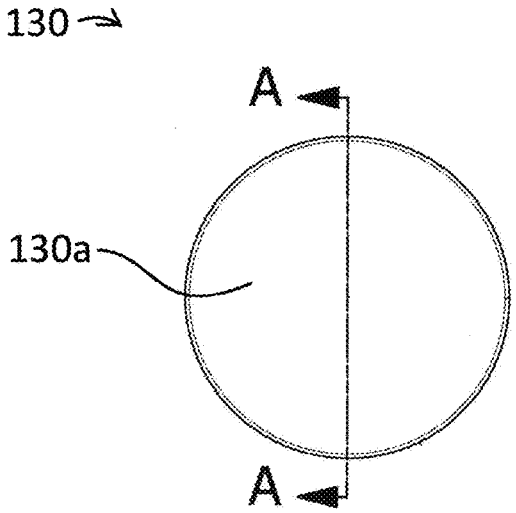
FIG. 2A illustrates a top perspective view of a lid member, according to an exemplary embodiment of the present general inventive concept.

FIG. 2A illustrates a top perspective view of a lid member 130, according to an exemplary embodiment of the present general inventive concept.

Figure 2B:
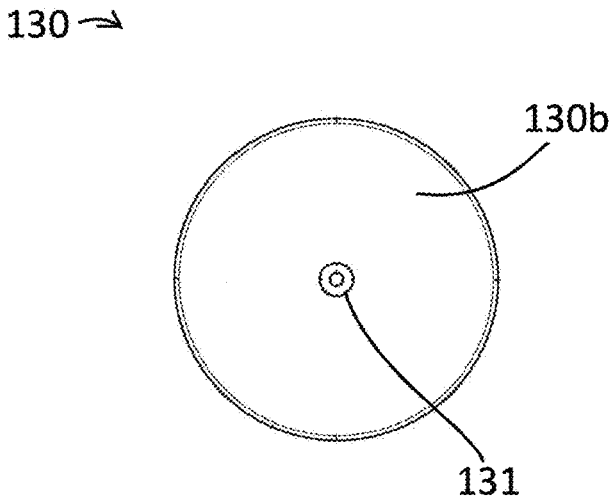
FIG. 2B illustrates a bottom perspective view of the lid member, according to an exemplary embodiment of the present general inventive concept.

FIG. 2B illustrates a bottom perspective view of the lid member 130, according to an exemplary embodiment of the present general inventive concept.

Figure 2C:
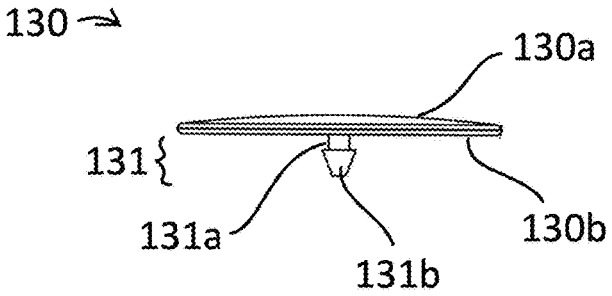
FIG. 2C illustrates a side perspective view of the lid member, according to an exemplary embodiment of the present general inventive concept.

FIG. 2C illustrates a side perspective view of the lid member 130, according to an exemplary embodiment of the present general inventive concept.

The lid member 130 may include a top surface 130*a*, a bottom surface 130*b*, and an extended bulbous member 131, but is not limited thereto.

The extended bulbous member 131 may include a top portion 131*a* and a bottom portion 131*b*, but is not limited thereto.

The extended bulbous member 131 may be disposed on at least a center portion of the bottom surface 130*b*.

Figure 3A:
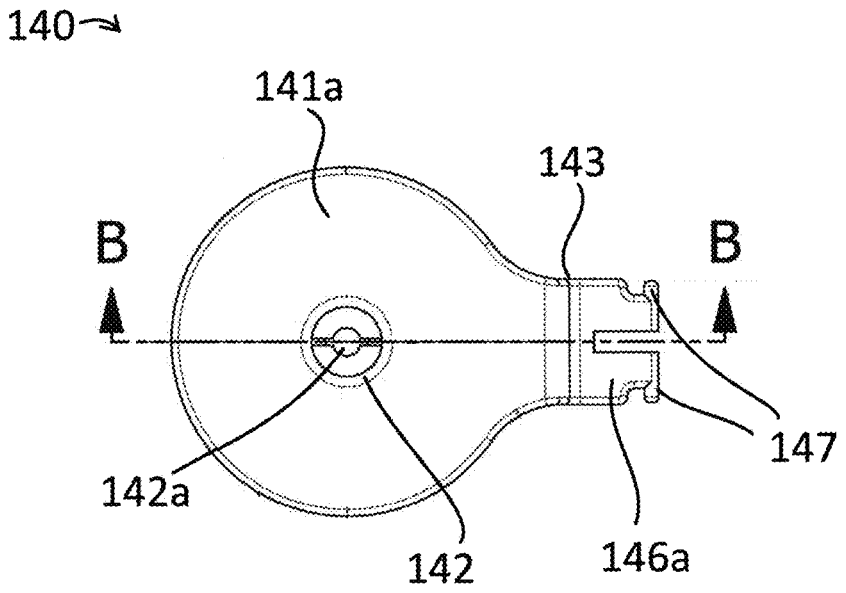
FIG. 3A illustrates a top perspective view of a pivoting member, according to an exemplary embodiment of the present general inventive concept.

FIG. 3A illustrates a top perspective view of a pivoting member 140, according to an exemplary embodiment of the present general inventive concept.

Figure 3B:
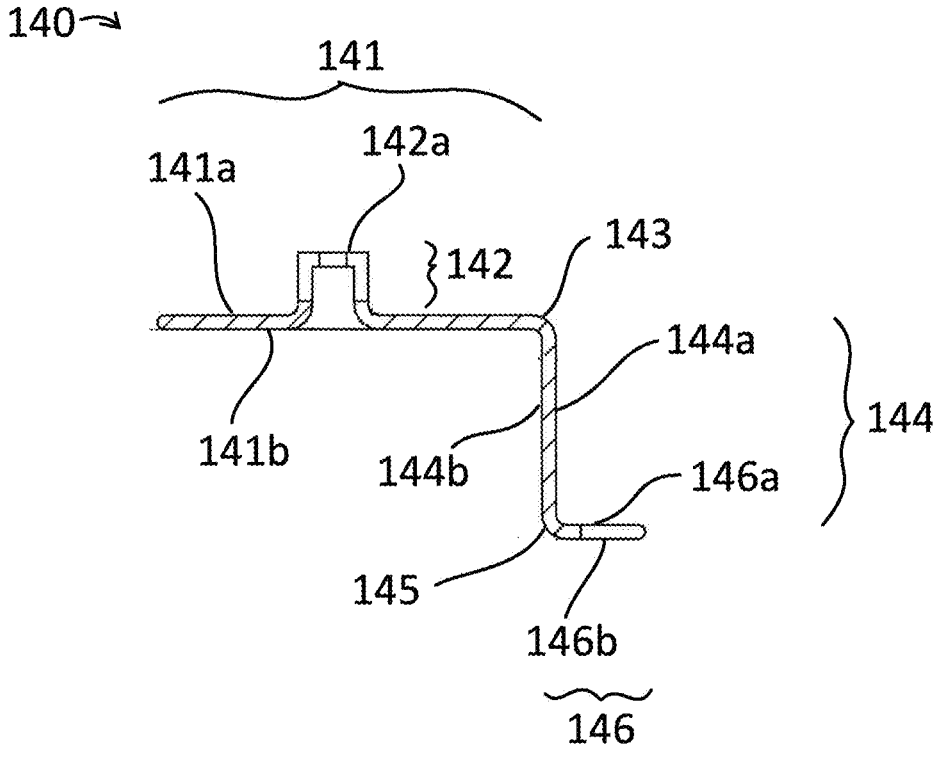
FIG. 3B illustrates a cross-sectional view of FIG. 3A taken along B-B of the pivoting member, according to an exemplary embodiment of the present general inventive concept.

FIG. 3B illustrates a cross-sectional view of FIG. 3A taken along B-B of the pivoting member 140, according to an exemplary embodiment of the present general inventive concept.

Figure 3C:
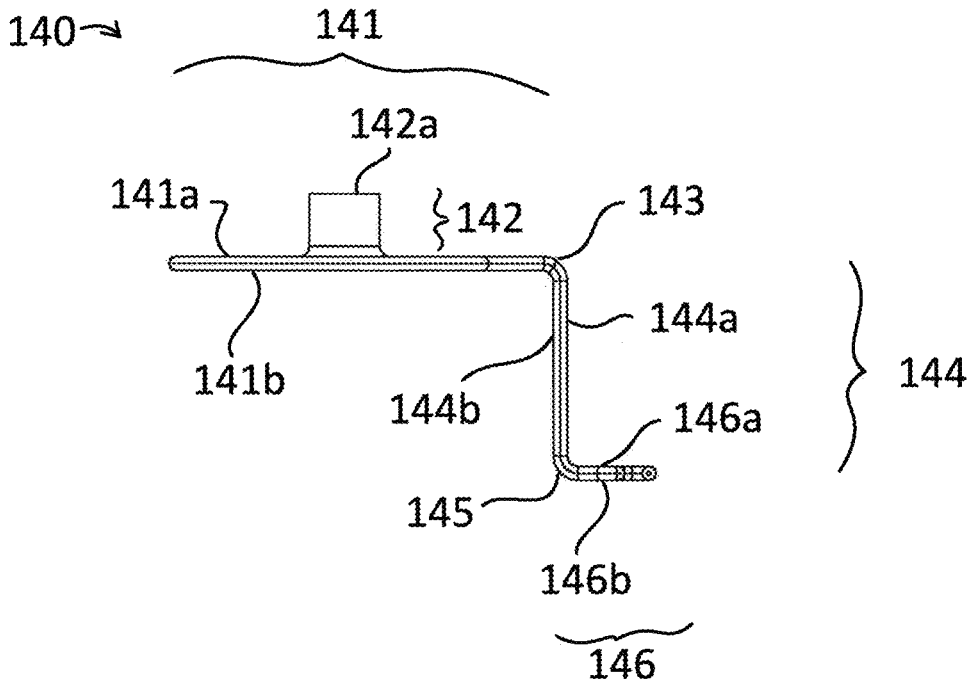
FIG. 3C illustrates a side perspective view of the pivoting member, according to an exemplary embodiment of the present general inventive concept.

FIG. 3C illustrates a side perspective view of the pivoting member 140, according to an exemplary embodiment of the present general inventive concept.

The pivoting member 140 may include a circular lateral stem 141, a protruding portion 142, a first corner portion 143, a vertical stem 144, a second corner portion 145, a second lateral stem 146, and a plurality of tabs 147, but is not limited thereto.

The circular lateral stem 141 may include a top surface 141*a* and a bottom surface 141*b*, but is not limited thereto.

The protruding portion 142 may include a bulbous-receiving aperture 142*a*, but is not limited thereto.

The vertical stem 144 may include a first surface 144*a* and a second surface 144*b*, but is not limited thereto.

The second lateral stem 146 may include a top surface 146*a* and a bottom surface 146*b*, but is not limited thereto.

The pivoting member 140 may be constructed such that the vertical stem 144 is perpendicular to the circular lateral stem 141 at the first corner portion 143 (i.e. a first edge) in a direction away from the bottom surface 141*b*. Moreover, the pivoting member 140 may be constructed, such that the second lateral stem 146 is perpendicular to the vertical stem 144 at the second corner portion 145 (i.e. a second edge) in a direction away from the first surface 144*a*.

The protruding portion 142 may be disposed on at least a center portion of the top surface 141*a* of the circular lateral stem 141. The plurality of tabs 147 may be disposed on at least an edge of the second lateral stem 146.

Figure 4A:
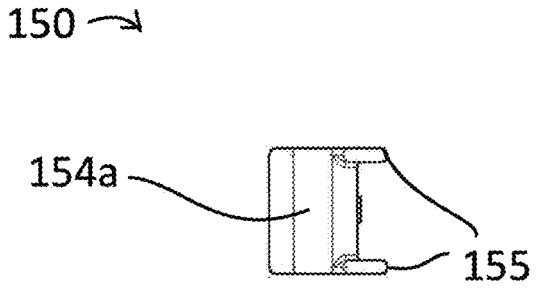
FIG. 4A illustrates a top perspective view of a fixed member, according to an exemplary embodiment of the present general inventive concept.

FIG. 4A illustrates a top perspective view of a fixed member 150, according to an exemplary embodiment of the present general inventive concept.

Figure 4B:
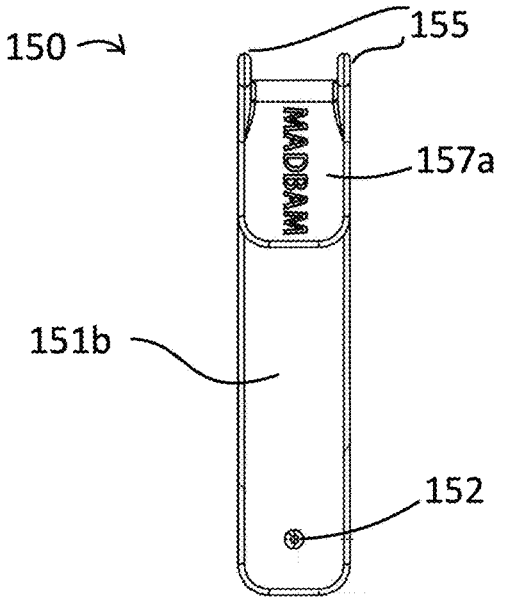
FIG. 4B illustrates a front perspective view of the fixed member, according to an exemplary embodiment of the present general inventive concept.

FIG. 4B illustrates a front perspective view of the fixed member 150, according to an exemplary embodiment of the present general inventive concept.

Figure 4C:
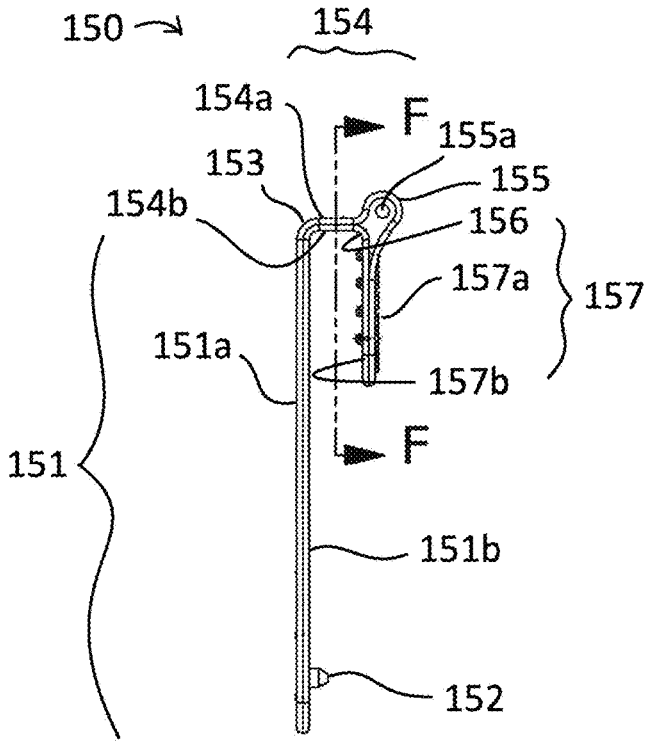
FIG. 4C illustrates a side perspective view of the fixed member, according to an exemplary embodiment of the present general inventive concept.

FIG. 4C illustrates a side perspective view of the fixed member 150, according to an exemplary embodiment of the present general inventive concept.

Figure 4D:
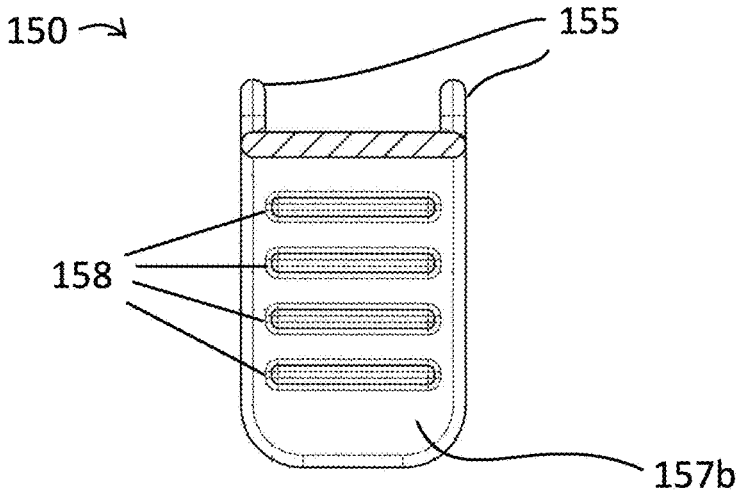
FIG. 4D illustrates a cross-sectional view of FIG. 4C taken along F-F of the fixed member, according to an exemplary embodiment of the present general inventive concept.

FIG. 4D illustrates a cross-sectional view of FIG. 4C taken along F-F of the fixed member 150, according to an exemplary embodiment of the present general inventive concept.

The fixed member 150 may include a first vertical stem 151, a bulbous member 152, a first corner portion 153, a lateral stem 154, a plurality of arms 155, a second corner portion 156, a second vertical stem 157, and at least one ridge 158, but is not limited thereto.

The first vertical stem 151 may include a first surface 151*a* and a second surface 151*b*, but is not limited thereto.

The lateral stem 154 may include a top surface 154*a* and a bottom surface 154*b*, but is not limited thereto.

The plurality of arms 155 may include a plurality of tab-receiving apertures 155*a*, but is not limited thereto.

The second vertical stem 157 may include a first surface 157*a* and a second surface 157*b*, but is not limited thereto.

The fixed member 150 may be constructed such that the lateral stem 154 is perpendicular to the first vertical stem 151 at the first corner portion 153 (i.e. a first edge) in a direction away from the second surface 151*b*. Moreover, the fixed member 150 may be constructed such that the second vertical stem 157 is perpendicular to the lateral stem 154 at the second corner portion 156 (i.e. a second edge) in a direction away from the bottom surface 154*b*.

The bulbous member 152 may be disposed on at least a bottom portion of the second surface 151*b* of the first vertical stem 151. The plurality of arms 155 may be disposed on at least a top portion of the second corner portion 156. The at least one ridge 158 may be disposed on at least a portion of the second surface 157*b* of the second vertical stem 157.

FIG. 5A illustrates a side perspective view of the beverage holder container cap 100, according to an exemplary embodiment of the present general inventive concept.

FIG. 5B illustrates a cross-sectional view of FIG. 5A taken along A-A of the beverage holder container cap 100, according to an exemplary embodiment of the present general inventive concept.

Figure 6A:
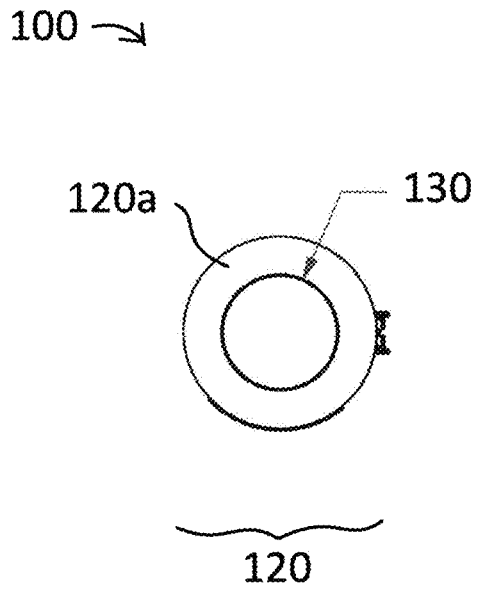
FIG. 6A illustrates a top view of the beverage holder container cap, according to another exemplary embodiment of the present general inventive concept.

FIG. 6A illustrates a top view of the beverage holder container cap 100, according to another exemplary embodiment of the present general inventive concept.

Figure 6B:
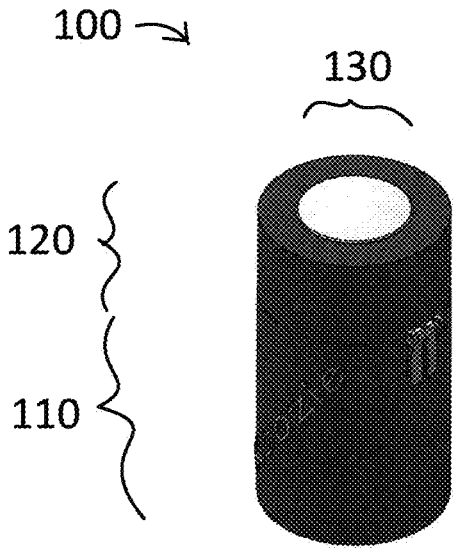
FIG. 6B illustrates a top isometric perspective view of the beverage holder container cap, according to another exemplary embodiment of the present general inventive concept.

FIG. 6B illustrates a top isometric perspective view of the beverage holder container cap 100, according to another exemplary embodiment of the present general inventive concept.

Referring to FIG. 1, the pivoting member 140 may be affixed and/or adhered to the covering member 120. Specifically, the protruding portion 142 may be inserted into the protrusion-receiving aperture 121, such that the top surface 141*a* of the pivoting member 140 is in substantial contact with the bottom surface 120*b* of the covering member 120. Moreover, the pivoting member 140 may include flexible material, such that the pivoting member 140 adjusts a shape of the protruding portion 142 to a predetermined size similar to a diameter of the protrusion-receiving aperture 121, such that the protruding portion 142 may snugly fit within the protrusion-receiving aperture 121.

Additionally, the first corner portion 143, the first surface 144*a*, and the second corner portion 145 may be in substantial contact with at least a portion of an inner surface of the cylindrical surface 120*c*.

Referring to FIGS. 1, and 5A through 6B, the lid member 130 may be affixed and/or adhered to the covering member 120 and the pivoting member 140. Specifically, the extended bulbous member 131 may be inserted into the protrusion-receiving aperture 121, such that the bottom surface 130*b* of the lid member 130 is in substantial contact with the top surface 120*a* of the covering member 120. The top surface 130*a* of the lid member 130 may be directed outward away from the top surface 120*a* of the covering member 120. The lid member 130 may seal the contents and prevent temperature changes, such as keeping the temperature of the can 10 cool by blocking a gradient of an external temperature from reaching the interior of the beverage holder container cap 100, which may cause the can 10 to increase in temperature.

Furthermore, the extended bulbous member 131 may be inserted into the bulbous-receiving aperture 142*a*. More specifically, the bulbous-receiving aperture 142*a* may deform in shape (i.e. expand outward), such that the bottom portion 131*b* of the extended bulbous member 131 penetrates therein, such that the bulbous-receiving aperture 142*a* returns to its original shape after the top portion 131*a* and the bottom portion 131*b* of the extended bulbous member 131 are completely within the bulbous-receiving aperture 142*a* and the bottom surface 120*b* of the covering member 120 is in substantial contact with the top surface 141*a* of the circular lateral stem 141. Alternatively, the bottom portion 131*b* of the extended bulbous member 131 may deform in shape (i.e. contract inward), such that the bulbous-receiving aperture 142*a* receives the bottom portion 131*b* of the extended bulbous member 131, such that the bottom portion 131*b* of the extended bulbous member 131 returns to its original shape after the top portion 131*a* and the bottom portion 131*b* of the extended bulbous member 131 are completely within the bulbous-receiving aperture 142*a* and the bottom surface 120*b* of the covering member 120 is in substantial contact with the top surface 141*a* of the circular lateral stem 141. As such, the extended bulbous member 131 may be considered snapped into the bulbous-receiving aperture 142*a*.

Referring to FIGS. 1 and 4A through 6B, the fixed member 150 may be affixed and/or adhered to the fixed member-receiving groove 113. Specifically, the bottom surface 154*b* of the lateral stem 154 may be in substantial contact with the fixed member-receiving groove 113. Moreover, the second surface 151*b* of the first vertical stem 151 may be in substantial contact with at least a portion of the inner surface of the main body 111 and the second surface 157*b* of the second vertical stem 157 may be in substantial contact with at least a portion of an outer surface of the main body 111. Furthermore, the at least one ridge 158 may increase friction on the outer surface of the main body 111, such that the fixed member 150 is not easily removed from the main body 111. As such, the first surface 151*a* of the first vertical stem 151, the top surface 154*a* of the lateral stem 154, and the first surface 157*a* of the second vertical stem 157 may face a direction away from the main body 111 with respect to the fixed member 150 in substantial contact with the main body 111. Also, the bulbous member 152 may be inserted into the bulbous-receiving groove 114, such that the fixed member 150 resists removal from the can-holding member 110.

The pivoting member 140 may be affixed and/or adhered to the fixed member 150. Specifically, each of the plurality of tabs 147 of the pivoting member 140 may be inserted into each of the plurality of tab-receiving apertures 155*a* on each of the plurality of arms 155. More specifically, each of the plurality of tabs 147 may deform (i.e. bend inwards towards each other), such that each of the plurality of arms 155 receives each of the plurality of tabs 147 therein. Furthermore, each of the plurality of tabs 147 may return to the original shape after each of the plurality of tabs 147 are inserted into each of the plurality of tab-receiving apertures 155*a*. Alternatively, each of the plurality of arms 155 may deform (i.e. bend outwards away from each other), such that each of the plurality of tabs 147 are inserted into each of the plurality of tab-receiving apertures 155*a*. Furthermore, each of the plurality of arms 155 may return to their original shape after each of the plurality of arms 155 receives each of the plurality of tabs 147.

Referring to FIGS. 1 through 6B, the top surface 156*a* of the second lateral stem 146 may be in substantial contact with at least a portion of the intermediary surface 120*d*. Additionally, the bottom surface 146*b* of the second lateral stem 146 may be in substantial contact with at least a portion of the top surface 154*a* of the lateral stem 154, such that the pivoting member 140 may be in a first position (i.e. closed). As such, the covering member 120 may enclose the can 10 therein. Moreover, the pivoting member 140 may be manipulated, such that the pivoting member 140 pivots in a direction away from the can-holding member 110 along a juncture of each of the plurality of tabs 147 and each of the plurality of tab-receiving apertures 155*a*. As such, the pivoting member 140 may be pushed and/or pulled in to a second position (i.e. open), such that the pivoting member 140 is substantially perpendicular to the fixed member 150. As such, the covering member 120 may pivot in response to a movement of the pivoting member 140.

Referring to FIGS. 1 through 6B, in the closed position, the bottom surface 141*b* of the circular lateral stem 141 may be in substantial contact with a top surface of the can 10 that may be inserted into the can-holding member 110. In the open position, a user may drink from the can 10.

The beverage holder container cap 100 may protect the can 10 from spilling, as well as, keep the can 10 at a desired temperature.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A beverage holding container to hold a can therein, the beverage holding container comprising:

a can-holding member to store the can therein, the can-holding member comprising:

a fixed member-receiving groove disposed on a portion of a top edge of the can-holding member, and a bulbous-receiving groove disposed on a portion of an inner surface of the can-holding member;

a fixed member having at least a portion thereof inserted within the can-holding member, the fixed member comprising:

a lateral stem affixed to the fixed member-receiving groove, a first vertical stem perpendicularly disposed on a first end of the lateral stem to affix to the inner surface of the can-holding member, and a second vertical stem perpendicularly disposed on a second end of the lateral stem to affix to an outer surface of the can-holding member;

a pivoting member pivotally connected to the fixed member to pivot from a first position to a second position; and a covering member connected to the pivoting member to keep the can enclosed when the pivoting member is in the first position, such that at least a portion of the pivoting member is disposed within an interior surface of the covering member.

2. The beverage holder container cap of claim 1, wherein the fixed member further comprises a bulbous member disposed on a bottom portion of the first vertical stem to be inserted into the bulbous-receiving groove, such that the fixed member resists removal from the can-holding member.

3. The beverage holder container cap of claim 1, wherein the fixed member further comprises at least one ridge disposed on a portion of a surface of the second vertical stem in contact with the outer surface of the can-holding member to increase friction of the fixed member on the outer surface of the can-holding member.

4. The beverage holder container cap of claim 1, wherein the fixed member further comprises:

a plurality of arms disposed on the second end of the lateral stem; and a plurality of tab-receiving apertures disposed on a portion of the plurality of arms.

5. The beverage holder container cap of claim 4, wherein the pivoting member comprises:

a vertical stem affixed to an inner portion of the covering member, such that the covering member pivots in response to movement of the pivoting member;

a circular lateral stem perpendicularly disposed on a first edge to be affixed on a bottom surface of the covering member; and a second lateral stem perpendicularly disposed on a second edge to affix to the plurality of arms.

6. The beverage holder container cap of claim 5, wherein the pivoting member further comprises a plurality of tabs disposed on an end of the second lateral stem to affix to the plurality of tab-receiving apertures, such that each of the plurality of tabs deforms in response to being inserted into the plurality of tab-receiving apertures.

7. The beverage holder container cap of claim 1, further comprises:

a lid member affixed to a portion of a top surface of the covering member to prevent a change in temperature within an interior portion of the beverage holder container cap.

8. A beverage holding container to hold a can therein, the beverage holding container comprising:

a can-holding member to store the can therein, the can-holding member comprising:

a fixed member-receiving groove disposed on a portion of a top edge of the can-holding member, and a bulbous-receiving groove disposed on a portion of an inner surface of the can-holding member;

a fixed member, comprising:

a lateral stem affixed to the fixed member-receiving groove, a first vertical stem perpendicularly disposed on a first end of the lateral stem to affix to the inner surface of the can-holding member, and a second vertical stem perpendicularly disposed on a second end of the lateral stem to affix to an outer surface of the can-holding member;

a pivoting member pivotally connected to the fixed member to pivot from a first position to a second position; and a covering member connected to the pivoting member to keep the can enclosed when the pivoting member is in the first position.

* * * * *